US005984637A

United States Patent [19]

Matsuo

[11] Patent Number: 5,984,637

[45] Date of Patent: Nov. 16, 1999

[54] COOLING MEDIUM PATH STRUCTURE FOR GAS TURBINE BLADE

[75] Inventor: Asaharu Matsuo, Tokyo, Japan

[73] Assignee: Mitsubishi Heavy Industries, Ltd., Tokyo, Japan

[21] Appl. No.: 09/027,201

[22] Filed: Feb. 20, 1998

[30] Foreign Application Priority Data

Feb. 21, 1997 [JP] Japan ..... 9-037647

[51] Int. Cl.[6] ..... F01D 5/08

[52] U.S. Cl. ..... 416/97 R; 416/95; 416/96 R; 416/220 R; 415/115; 415/135; 415/136

[58] Field of Search ..... 416/97 R, 95, 416/96 R, 220 R; 415/115, 135, 136

[56] References Cited

U.S. PATENT DOCUMENTS

| | | | |
|---|---|---|---|
| 4,118,136 | 10/1978 | Corsmeier et al. | 403/386 |
| 4,136,516 | 1/1979 | Corsmeier | 60/39.09 |
| 4,190,398 | 2/1980 | Corsmeier et al. | 415/114 |
| 5,318,404 | 6/1994 | Carreno et al. | 416/96 R |
| 5,593,274 | 1/1997 | Carreno et al. | 415/115 |
| 5,795,130 | 8/1998 | Suenaga et al. | 416/95 |
| 5,823,743 | 10/1998 | Faulkner | 416/96 R |
| 5,846,048 | 12/1998 | Tomita et al. | 415/115 |

*Primary Examiner*—Edward K. Look
*Assistant Examiner*—Matthew T. Shanley
*Attorney, Agent, or Firm*—Wenderoth, Lind & Ponack, L.L.P.

[57] ABSTRACT

A cooling medium path structure for cooling a gas turbine blade. The structure includes a disk-side cooling medium path, a blade-side cooling medium path formed at the root portion of the blade and a delivery block disposed between the two cooling medium paths so as to establish communication therebetween. The delivery block is provided with an elastic engaging section which comes into elastic and line-contact with the disk-side cooling medium path and the blade-side cooling medium path. Thus, the sealing property of the contact portions of the structure is secured so as to allow a cooling medium to be supplied without leaking from the cooling medium paths. The heat of the cooling medium, generated as a result of cooling the high-temperature portion of the gas turbine, can be recovered so as to make the best use of the heated medium.

12 Claims, 11 Drawing Sheets

COOLING MEDIUM PATH STRUCTURE FOR GAS TURBINE BLADE

BACKGROUND OF THE INVENTION

1. Field of the Invention

The present invention relates to a cooling medium path structure of a root portion of a gas turbine blade.

2. Description of the Related Art

The structure of a conventional cooling medium path of the above type will be described with reference to FIGS. 11 through 13. In the outer periphery of a turbine disk 2 there are formed in the axial direction a plurality of inverted Christmas tree-shaped blade grooves 7 at equal intervals in the circumferential direction so as to correspond in number to turbine blades 1 fitted in the respective stages.

At the same time, in a root portion of the turbine blade 1, there are provided inverted Christmas tree-shaped portions 8 which can be assembled into the above-mentioned inverted Christmas tree-shaped grooves 7 with a very small gap therebetween.

Each turbine blade 1 is inserted to be assembled into the respective groove of the turbine disk 2 one by one in the axial direction so that during the operation of the turbine, the turbine disk 2 bears the centrifugal force and the vibrating force through a teeth engagement of the inverted Christmas tree-shaped groove 7 and the same-shaped portion 8.

Further,once the turbine blade 1 is so assembled into the turbine disk 2, then it is so designed that the shapes of the blade groove 7 of the turbine disk 2 and the mating portion 8 at the root portion of the turbine blade 1 secure a cooling medium path 9 for allowing a cooling medium flow in the bottom portion of the blade 1.

The cooling medium (usually a compressed air) for cooling the turbine blades 1 passes through radial directional holes 10, which are the same in number as the blades of the respective stage and which are formed on the side of entrance of the turbine disk 2 and is introduced into a space 14 surrounded by sealing blocks 12 and 13.

After that, the cooling medium is introduced into the cooling medium path 9 formed at the bottom portion of the inverted Christmas tree-shaped portion 8, enters a passage (not shown) formed at the root portion of the turbine blade 1 and flows into the interior of the blade l thereby cooling the whole of the blade. The cooling medium having thus cooled the blade 1 is discharged into a subsequent gas path.

In the mentioned course of a series of flows of the cooling medium, the cooling medium path 9, which is formed between the blade groove 7 and the portion 8 formed at the root portion of the turbine blade 1, defines the space 14 surrounded by the sealing blocks 12 and 13 at the entrance of the disk 2 located on the upstream side of the above-mentioned gas path while it is defined by a sealing piece 15 and a fixing piece 16 at the exit of the disk 2 located on the downstream side of the gas path.

Normally, the upstream side sealing block 12 and the downstream side sealing piece 15 are provided for every two blades 1 and the upstream side sealing block 13 and the downstream side fixing piece 16 are provided for each blade 1 and all of these parts are assembled at their proper positions, respectively.

Accordingly, in order to assemble these parts and the other parts associated therewith, it becomes necessary to provide suitable spaces for receiving them in position so that it is unavoidable that gaps will be left unoccupied in some places even after assembly.

In FIGS. 11 and 13, reference numeral 17 designates a sealing plate for covering a small gap formed between the inverted Christmas tree-shaped groove 7 and the mating portion 8 of the same shape and since this plate 17 is usually used for each of the blades 1, there is left a space required for assembling it.

As described above, it has been usual with the conventional cooling medium path structure that there exist, in the structure, various kinds of spaces or gaps left intentionally or resultantly for the convenience of designing, manufacturing and assembling the entire structure so that even when cooling air or the like as a cooling medium is supplied through the holes drilled in the disk 2, it leaks from the gap around the cooling medium path or the sealing plate so that the cooling air or the like cannot be collected but is discharged into the gas path. Consequently, there has been a problem of recovering and using the cooling medium heated to a high temperature after being used for cooling and the resultant thermal efficiency loss has been unavoidable.

SUMMARY OF THE INVENTION

The present invention has been made to eliminate the abovedescribed disadvantages of the conventional cooling medium path structure and to provide a cooling medium path structure which is simple and which is capable of preventing the leakage of a cooling medium and facilitating supply and collection of the cooling medium.

The cooling medium path structure for a gas turbine blade according to the present invention comprises a disk-side cooling medium path provided in a turbine disk, a blade-side cooling medium path provided in a root portion of the blade, an elbow-shaped projection forming an entrance and an exit of both ends of the blade-side cooling medium path, and a delivery block disposed between the disk-side cooling medium path and the elbow-shaped projection so as to establish communication between them. The delivery block is provided with an elastic engaging section capable of coming into elastic contact with at least one of the elbow-shaped projection and the disk-side cooling medium path. And, the cooling medium paths of the present invention are intended to realize that the delivery of a cooling medium between the disk-side cooling medium paths and the blade-side cooling medium path is performed through the elbow-shaped projection and the delivery block such that the elastic engaging section of the delivery block comes into elastic contact with the elbow-shaped projection and the disk-side cooling medium path so that leakage of the cooling medium is prevented to secure the sealing performance of the cooling medium path and the flexible connection of the delivery block with the cooling medium paths is attained without giving rise to an adverse effect on the vibrating characteristic of the gas turbine blade.

With the basic structure described above, another feature of the present invention resides in that the elastic engaging section of the delivery block is formed of a ring-shaped projection and a plurality of slits extending axially from the open ends of the delivery block such that the ring-shaped projection comes into line-contact with the mating cooling medium path so that the flexibility of the delivery block with respect to the axial deviation from each of the cooling medium paths or the movement of the vibrations etc. of the blades is secured to a sufficient degree. Also the presence of the slits at the open ends of the delivery block secures the spring forces of the delivery block at both of the open ends resulting in further securing the sealing performance by the line contact of each of the projections with the mating cooling medium path.

Still another feature of the present invention resides in that the elastic engaging section of the delivery block is formed such that a plurality of ring-shaped members circumscribing the inner surface of the elbow-shaped projection or the disk-side cooling medium path and a plurality of ring-shaped members inscribing the outer surface of the delivery block are laid one above another, respectively. Also the ring-shaped members which come into contact with the inner surface of each of the cooling medium paths and the ring-shaped members which come into contact with the outer surface of the delivery block share their sealing positions, respectively. Further, since the respective ring-shaped members are urged toward the blade side due to a centrifugal force, their close contactability and sealing property are secured. Also, since the ring-shaped members themselves are movable in the radial direction, their flexibility with respect to the axial deviation of the delivery block from the disk-side or blade-side cooling medium path or the movement of the vibration etc. of each of the blades can be secured.

A further feature of the present invention resides in that the intermediate portion of the delivery block exposed outside the elbow-shaped projection and the disk of the turbine is covered with a spacer band so that the relative position of the elbow-shaped projection with respect to the disk of the turbine can be securely maintained.

A further feature of the present invention resides in that the delivery block comes into screw-engagement with at least one of the elbow-shaped projection and the disk-side cooling medium path so that when the delivery block is set at a predetermined position, the surface pressure of the contact surfaces of the two members is increased by making use of the clamping force of the screw-engagement thereby improving the sealing property of the delivery block.

A further feature of the present invention resides in that where the disk-side cooling medium path and the blade-side cooling medium path are connected to each other through the elbow-shaped delivery block, an E-type seal or a C-type seal is inserted into each of the connection portions of the delivery block and the two cooling medium paths so that the sealing property of the connected portions is improved by making the best use of the elastic force of the seals.

DETAILED DESCRIPTION OF THE PREFERRED EMBODIMENTS

Figure 11:
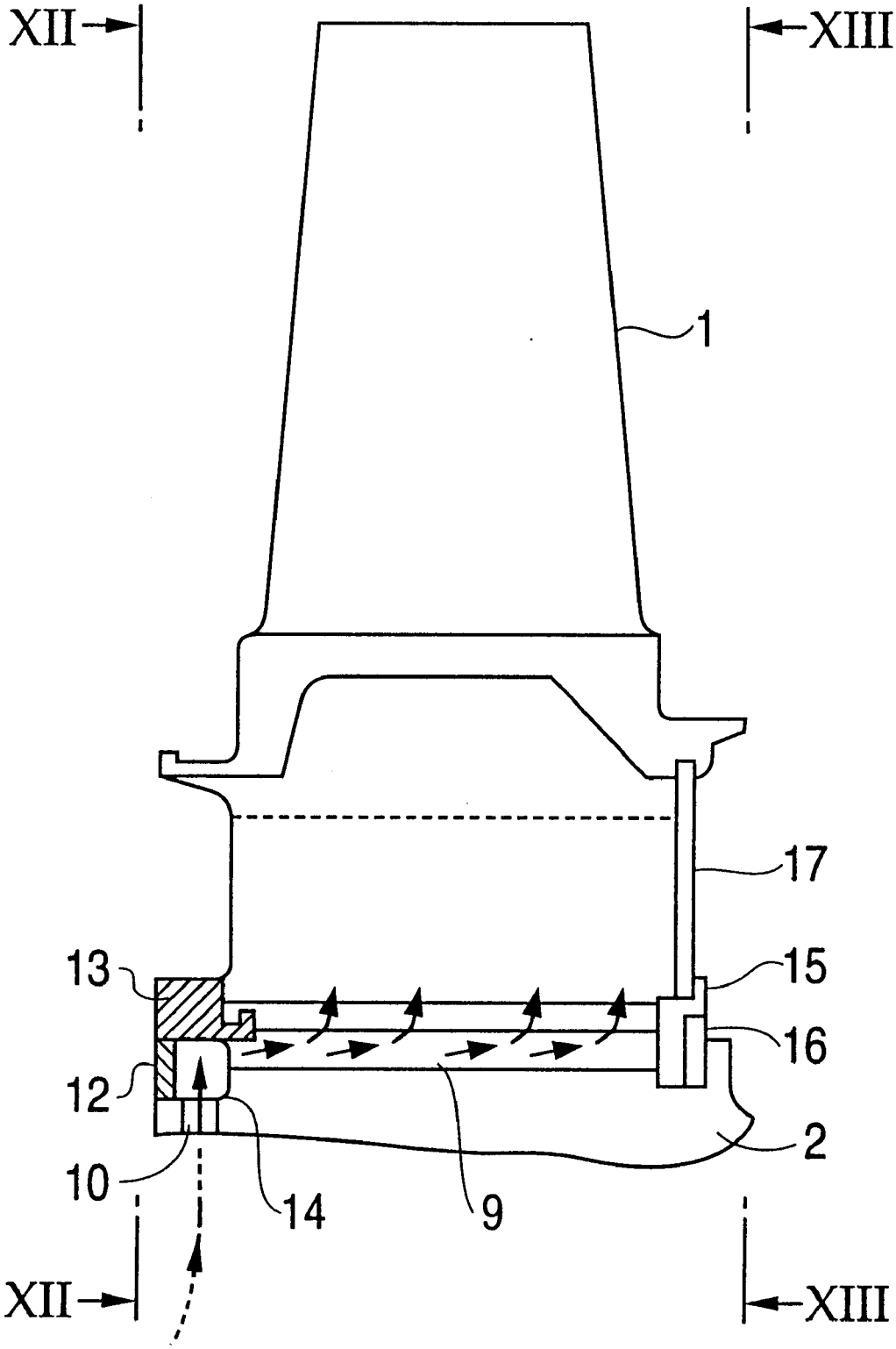
FIG. 11 (PRIOR ART)
FIG. 11 is a schematic diagram showing a structural relationship between a blade and a disk of a conventional gas turbine.
Figure 12:
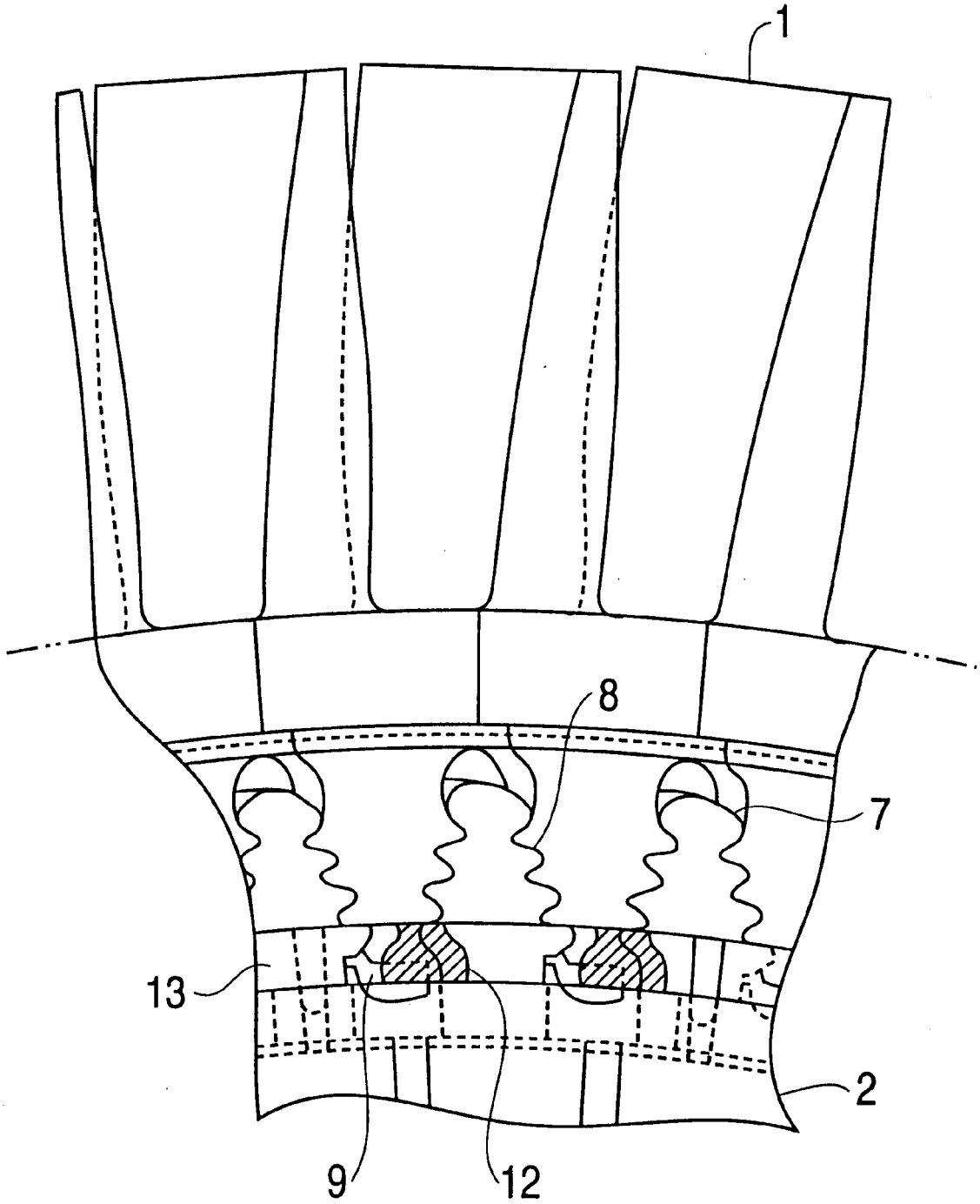
FIG. 12 (PRIOR ART)
FIG. 12 is a schematic diagram of an upstream side of the structure shown in FIG. 11 especially when viewed along the arrow-indicated XII—XII line.
Figure 13:
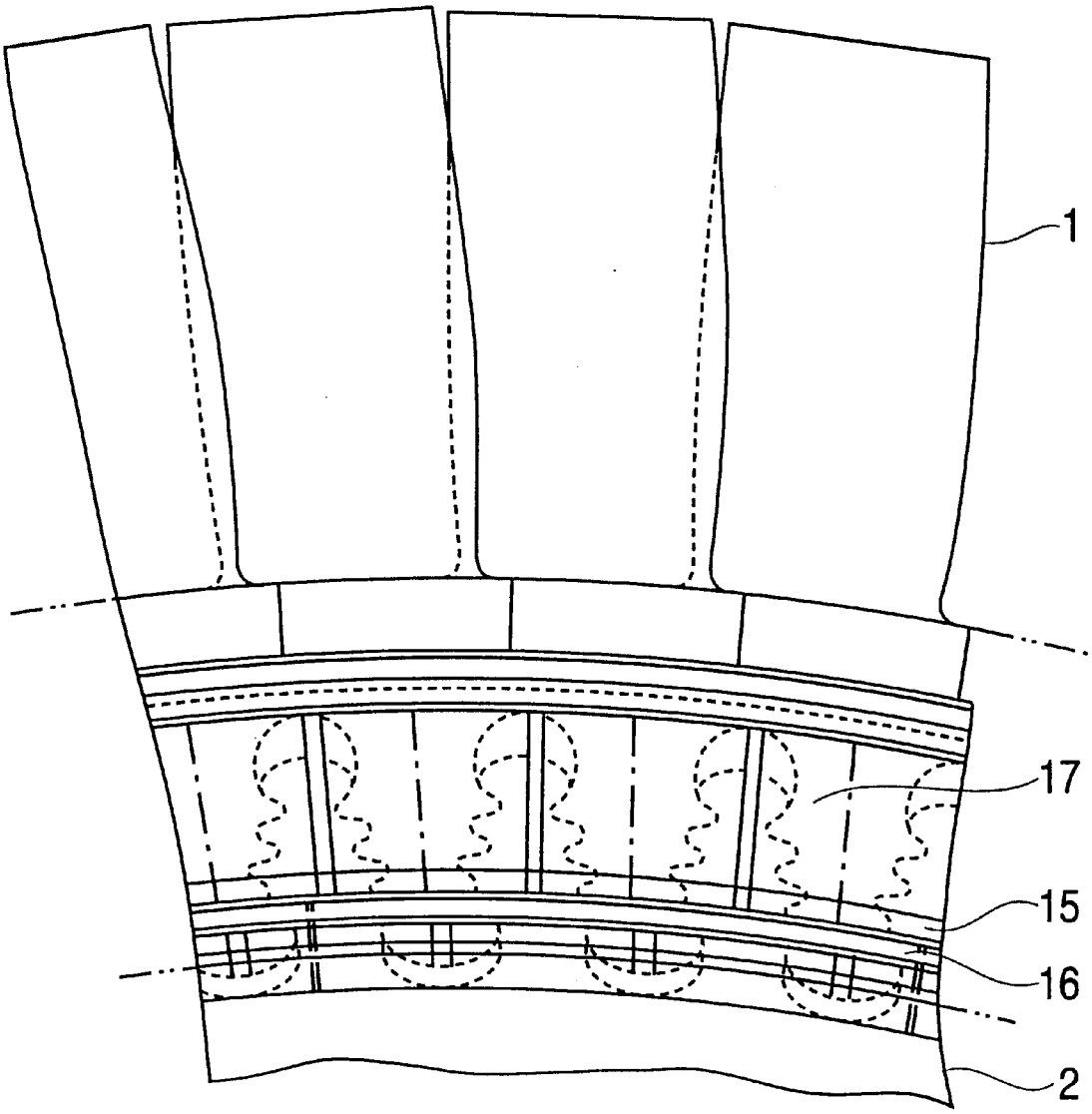
FIG. 13 (PRIOR ART)
FIG. 13 is a schematic diagram of a downstream side of the structure shown in FIG. 11 especially when viewed along the arrow-indicated XIII—XIII line.

A first embodiment of the present invention will now be described with reference to FIG. 1 wherein like parts are designated by like reference numerals used with respect to the structure of the conventional gas turbine described in the foregoing with reference to FIGS. 11 through 13 and no redundant description of these like parts is made herein.

Figure 1:
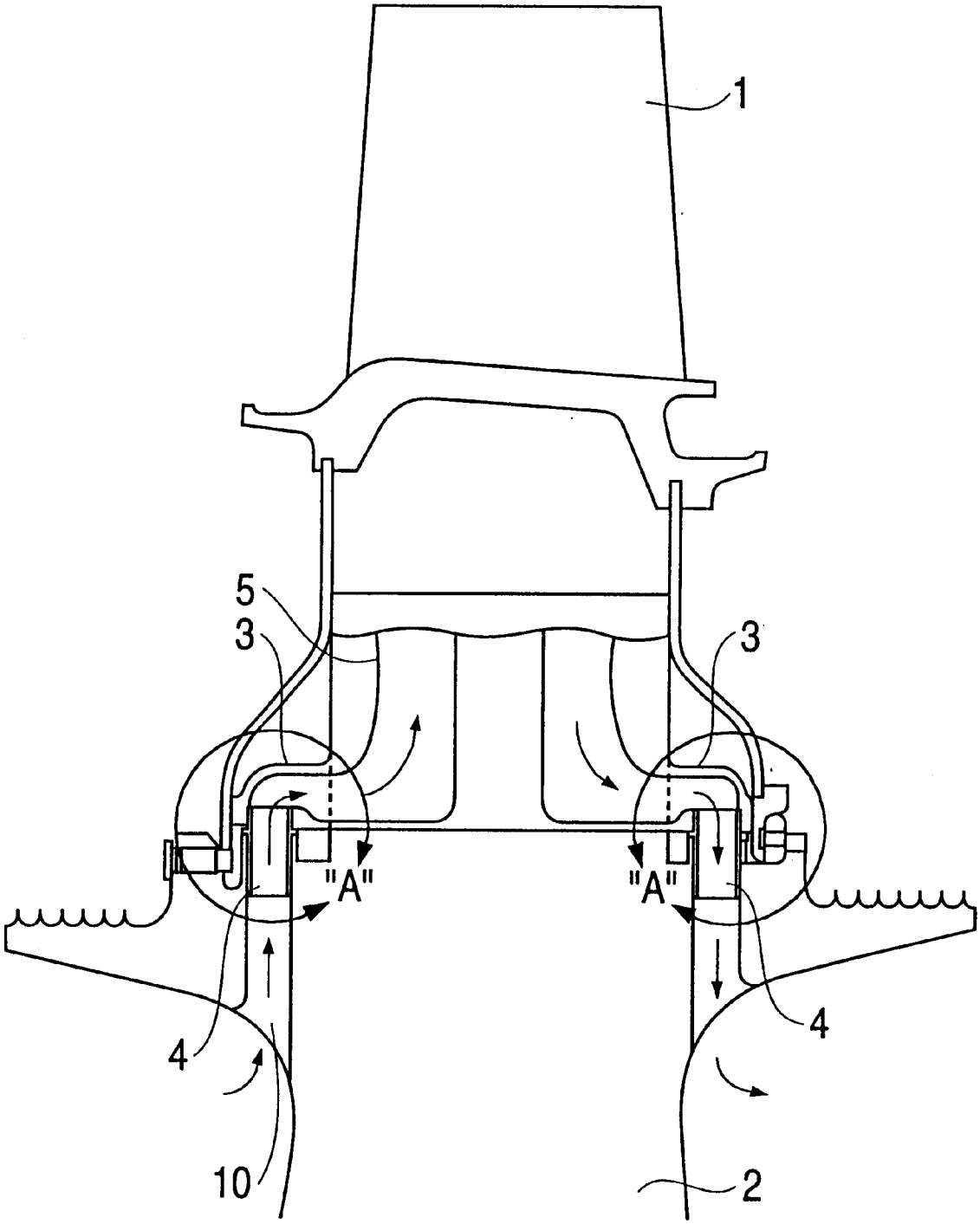
FIG. 1 is a schematic view showing a structural relationship between a blade and a disk of a gas turbine according to a first embodiment of the present invention.

In FIG. 1, reference numeral 1 designates a turbine blade whose root portion is in the shape of an inverted Christmas tree (not shown) and which is in engagement with a groove also having the shape of an inverted Christmas tree and formed in a turbine disk 2. The turbine disk 2 is provided with a plurality of radial directional cooling medium paths 10 for guiding a cooling medium. Further, in the root portion of the turbine blade 1 there is provided a cooling medium path 5 for guiding the cooling medium to a blade cooling section (not shown).

Figure 2:
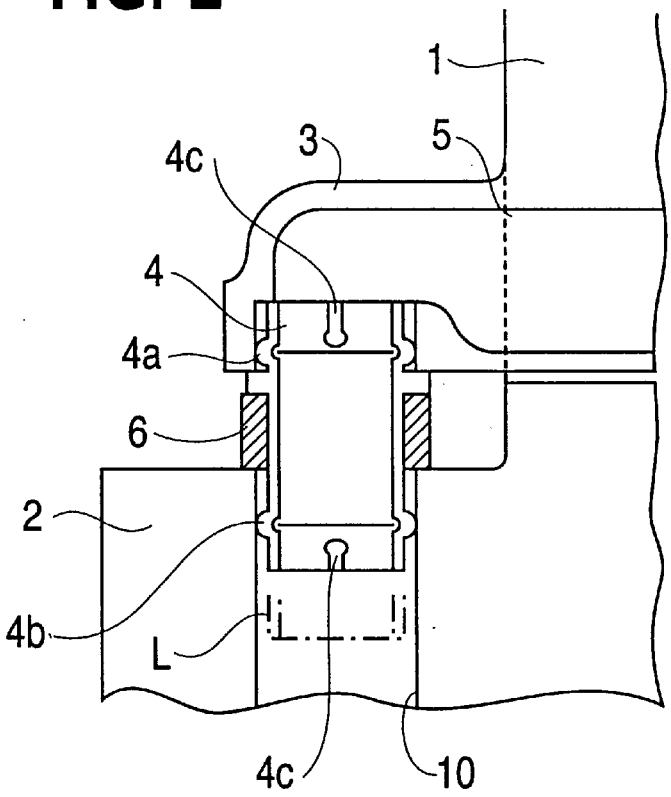
FIG. 2 is an illustrative view , on an enlarged scale, of A-section identified as in FIG. 1.

As shown in detail in FIG. 2, which is an enlarged sectional view of the A-portion shown in FIG. 1, an entrance and an exit of the cooling medium path 5 for the turbine blade 1 are formed with an elbowshaped projection 3 where a delivery block 4 in the shape of a thin tube is disposed so as to establish communication between the disk-side cooling medium path 10 and the blade-side cooling medium path 5.

The delivery block 4 has a ring-shaped projection 4*a* at a position near one end thereof which is fitted in the blade-side cooling medium path 5 and a ring-shaped projection 4*b* at a position near the other end thereof which is fitted in the disk-side cooling medium path 10, so that the surfaces of the ring-shaped projections 4*a* and 4*b* come into line-contact with the inner peripheral surfaces of the cooling medium paths 5 and 10, respectively.

Further, the delivery block 4 is provided at both ends thereof with a plurality of slits 4*c* extending in the axial direction of the delivery block 4 from near the ring-shaped projections 4*a* and 4*b* up to the ends, respectively. Further, the intermediate portion of the delivery block 4, that is, the portion lying outside the cooling medium paths 5 and 10 is wound with a spacer band 6 around its outer peripheral surface.

With the above structure, since the ring-shaped projections 4*a* and 4*b* on both sides of the delivery block 4 are in line-contact with the inner peripheral surfaces of the cooling medium paths 5 and 10, the flexibility of the delivery block 4 against a possible deviation of the axis thereof from the axis of each of the cooling medium paths 5 and 10 or against a possible movement due to vibrations etc. is maintained to thereby secure the sealing property of the delivery block 4 at the line-contact portions.

In addition, due to the provision of the plurality of slits 4*c* extending from near the projections 4*a* and 4*b* up to each end of the delivery block 4, a spring force acts on each of the projections 4*a* and 4*b* so that the line-contacts of the projections 4*a* and 4*b* with the cooling medium paths 5 and 10 can be further secured.

Further, the delivery block 4 shown by solid lines in FIG. 2 is set up at a position in such a manner that, as shown by a two-dot chain line L, the lower end of the delivery block 4 is inserted into the disk-side cooling medium path 10 and then the upper end thereof is inserted into the blade-side cooling medium path 5 in the elbow-shaped projection 3 while the lower end thereof is raised.

After the above process, the outer peripheral surface of the intermediate portion of the delivery block 4 lying outside the cooling medium paths 5 and 10 is covered with the spacer band 6 so that the delivery block 4 is held in position and protected against any external damage.

It is to be noted that the description here is made of the case where a cooling medium is supplied from the disc-side cooling medium path 10 toward the blade-side cooling medium path 5. However, there is also a cooling medium collection system which is substantially right and left symmetrical and extends from the blade side to the disk side and since this collection system is substantially the same in structure, function and effect as the supply system, the present invention will be described in this specification by stressing that the cooling medium supply system also covers the collecting system.

Figure 3:
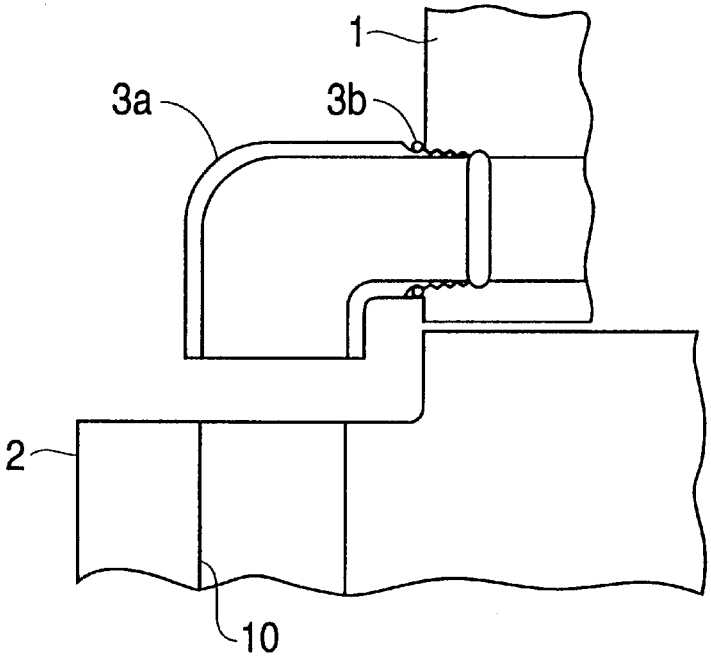
FIG. 3 is an illustrative view showing a partial modification of the structure shown in FIG. 2.

Further, a partial modification of said embodiment of the present invention is shown in FIG. 3 in which the elbow-shaped projection 3*a* is formed not integrally with, but separately from, the blade root portion and a terminal end of the projection 3*a* is inserted into the blade-side cooling medium path 5 to be integrated therewith by seal weld 3*b*.

Thus, by so forming the elbow-shaped projection 3*a*, it is possible to construct this portion in a more simplified manner.

It should be noted that the remaining structure and function of the delivery block 4 and other associated structure are the same as those shown in FIG. 2 and illustration thereof is omitted.

Figure 4:
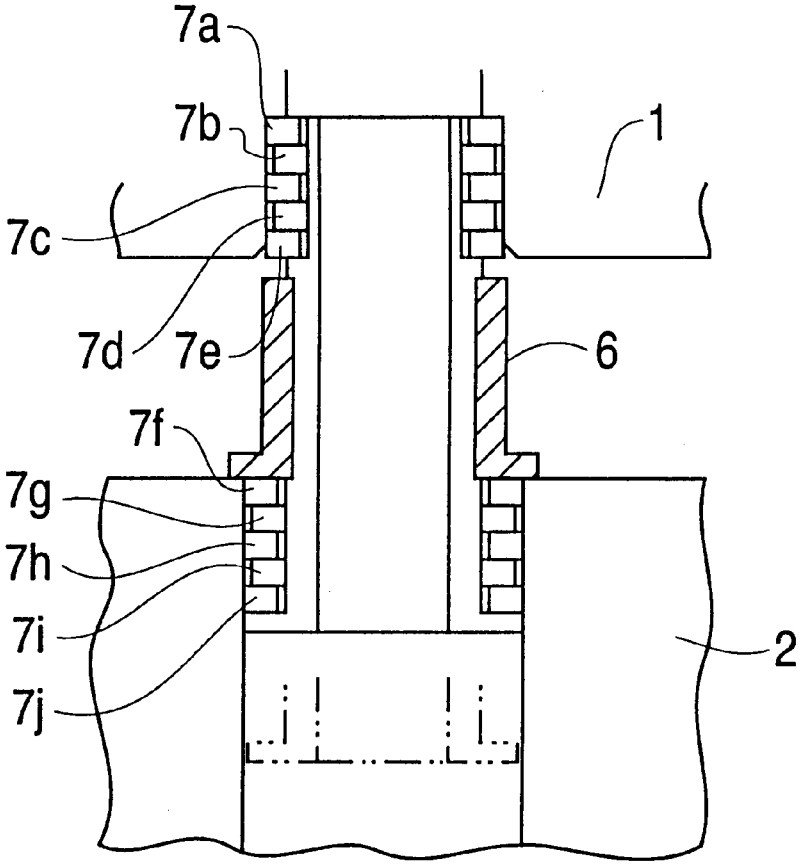
FIG. 4 is a schematic view mainly showing a delivery block disposed between a blade and a disk of a gas turbine according to a second embodiment of the present invention.

Next, a second embodiment of the present invention will be described with reference to FIGS. 4 through 6 wherein like parts are designated by like reference numerals with no redundant description of the like parts.

In this second embodiment, a plurality of ring-shaped members 7*a*–7*e* are arranged in layers at a position where the delivery block 4 is fitted into the blade-side cooling medium path 5 and a plurality of ring-shaped members 7*f*–7*j* are arranged in layers at a position where the delivery block 4 is fitted into the disk-side cooling medium path 10. These ring-shaped members 7*a*–7*i* have different inner and outer diameters between adjacent ring-shaped members alternately in the vertical direction and are made of materials having different coefficients of thermal expansion with the members of larger diameters having a larger coefficient of thermal expansion and vice versa.

That is, each of the members 7*a*, 7*c*, 7*e* and each of the members 7*f*, 7*h*, 7*j* are of a larger diameter and the outer peripheral surface thereof substantially circumscribes the inner surface of each of the cooling medium paths 5 and 10 while the inner peripheral surface thereof keeps a sufficient gap from the outer peripheral surface of the delivery block 4. Further, each of the members 7*b*, 7*d* which are arranged alternately with the members 7*a*, 7*c*, 7*e* and each of the members 7*g*, 7*i* which are arranged alternately with the members 7*f*, 7*h* and 7*j* are of a small diameter and the outer peripheral surface thereof maintains a sufficient gap from the inner peripheral surface of each of the cooling medium paths 5 and 10 while the inner peripheral surface thereof substantially inscribe the outer peripheral surface of the delivery block 4.

Further, the upper ring-shaped members 7*a*–7*e*, fitted in the blade-side cooling medium path 5, are arranged in layers substantially in close contact with one another and likewise, the lower ring-shaped members 7*f*–7*i* are arranged in layers substantially in close contact with one another.

Figure 5:
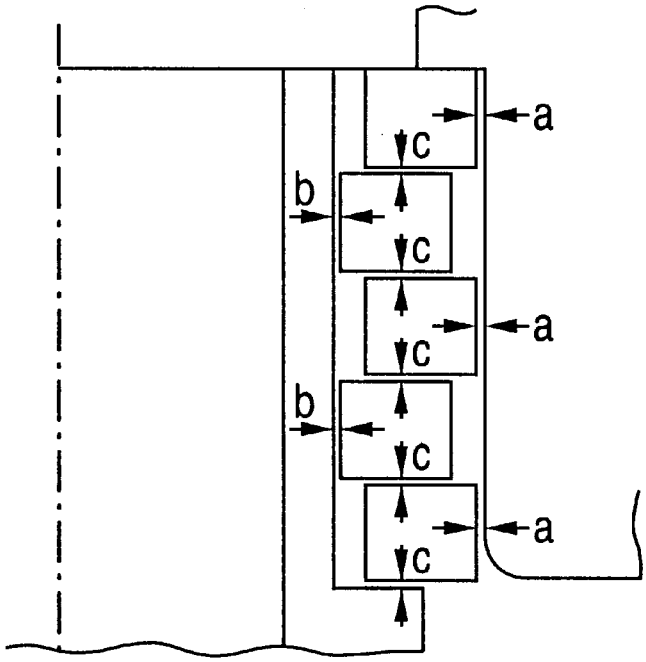
FIG. 5 is an illustrative view showing, on an enlarged scale, a state in which ring-shaped members, shown in FIG. 4, are assembled.
Figure 6:
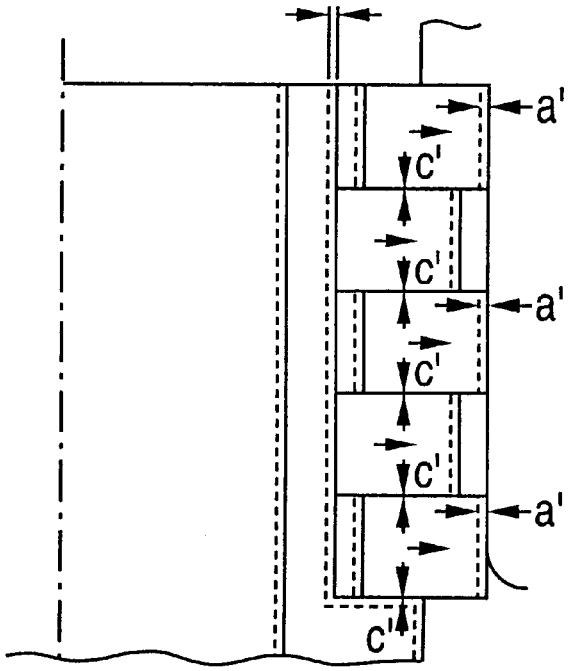
FIG. 6 is an illustrative view showing, on an enlarged scale, a state in which the ring-shaped members shown in FIG. 4 are in operation.

The above conditions of the ring-shaped members are shown in FIGS. 5 and 6 on an enlarged scale. That is, as shown in FIG. 5, the ring-shaped members 7*a*–7*j* are arranged such that, in order to secure a freedom of assembly, they keep a slight gap "a" (substantially equal to a contact) from the respective cooling medium paths 5 and 10 and a like slight gap "b" from the delivery block 4 and also keep a like gap "c" between member which are adjacent to one another in the vertical direction. However, when the gas turbine is in operation, the above-mentioned gaps a–c change to a'–c' due to a change in thermal expansion as shown in FIG. 6 so that the ring-shaped members are securely brought into close contact with one another so as to be in a completely gap-less state.

From the above circumstance, in this specification, the gaps a–c shown in FIG. 5 with respect to the ring-shaped members are described as being substantially equal to a contact. In this embodiment of the present invention, due to the arrangement of the ring-shaped members 7*a*–7*i* in the above manner, the sealing property of the structure id both the radial and vertical directions is secured by the close contact of the ring-shaped members with the cooling medium paths 5 and 10, the delivery block 4 or among themselves. Further, due to the sufficient gaps provided on the side opposite the contact portions of the ring-shaped members 7*a*–7*j*, the flexibility of the structure against axial displacement between the blade-side and disk-side cooling medium paths 5 and 10 or against the movement of vibrations etc. of the blades can be secured.

Next, a third embodiment of the present invention will be described with reference to FIGS. 7 through 9 wherein like parts are designated by like reference numerals used with respect to the above-described conventional structure and the structures according to the first and second embodiment of the present invention and a redundant description of these like parts is omitted.

This embodiment of the present invention features that the connection of the delivery block 4 to the turbine disk 2 or the elbow-shaped projection 3 is performed through a screw-mechanism. That is, the structure shown in FIG. 7 is such that a screw-threaded ring 8 having its inner and outer surfaces screw-threaded is screwed into the turbine disk 2. The delivery block 4 is brought into engagement with the inner screw-threaded surface of the ring 8 thereby securing the sealing property of the structure through such screw-engagement surfaces.

Figure 7:
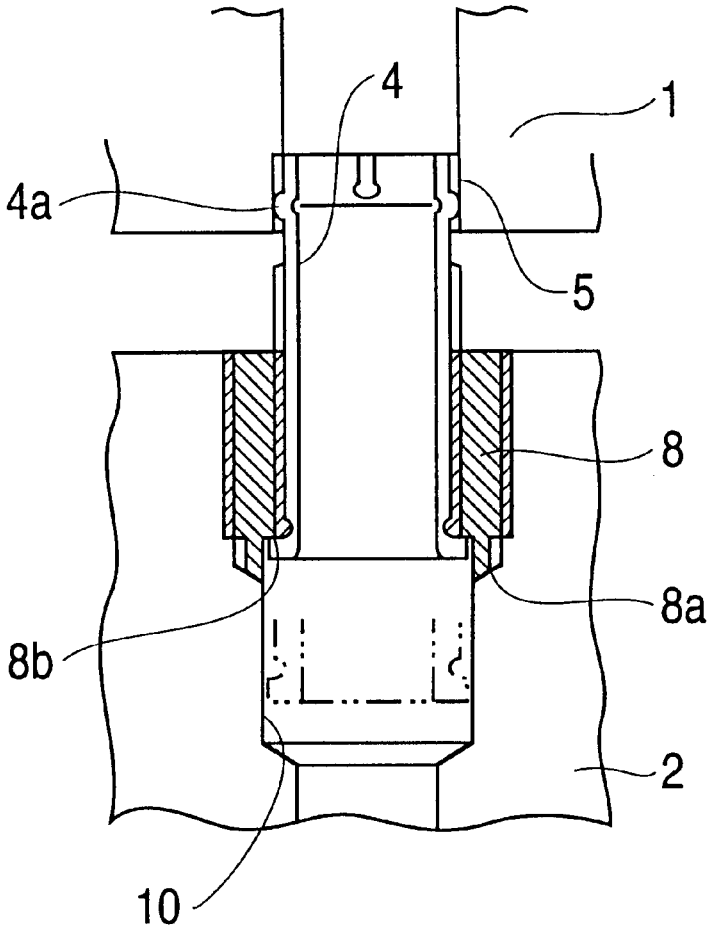
FIG. 7 is a schematic view of a delivery block between a blade and a disk of a gas turbine according to a third embodiment of the present invention.

In assembly, the ring 8 is placed in a predetermined position as shown in FIG. 7, then the delivery block 4 is caused to sink below the ring 8 as shown by a two-dot chain line and after that, the delivery block 4 is raised upward as it is turned round to thereby locate the delivery block 4 in the predetermined position shown in the figure.

The sealing of the delivery block 4 with respect to the blade-side cooling medium path 5 is provided by a flexible ring-shaped projection 4*a* while the sealing of the delivery block 4 with respect to the disk-side cooling medium path 10 is provided by the sealing surfaces 8*a* and 8*b* of the screw-threaded ring 8 coming into engagement with the the disc 2 and the delivery block 4.

Figure 8:
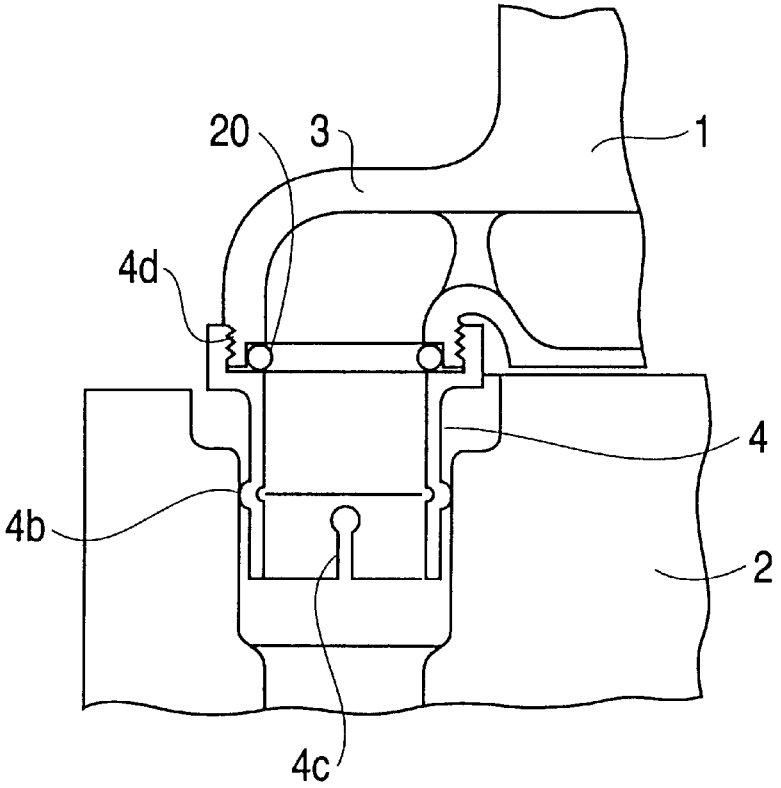
FIG. 8 is a schematic view showing a partial modification of the delivery block shown in FIG. 7.
Figure 9:
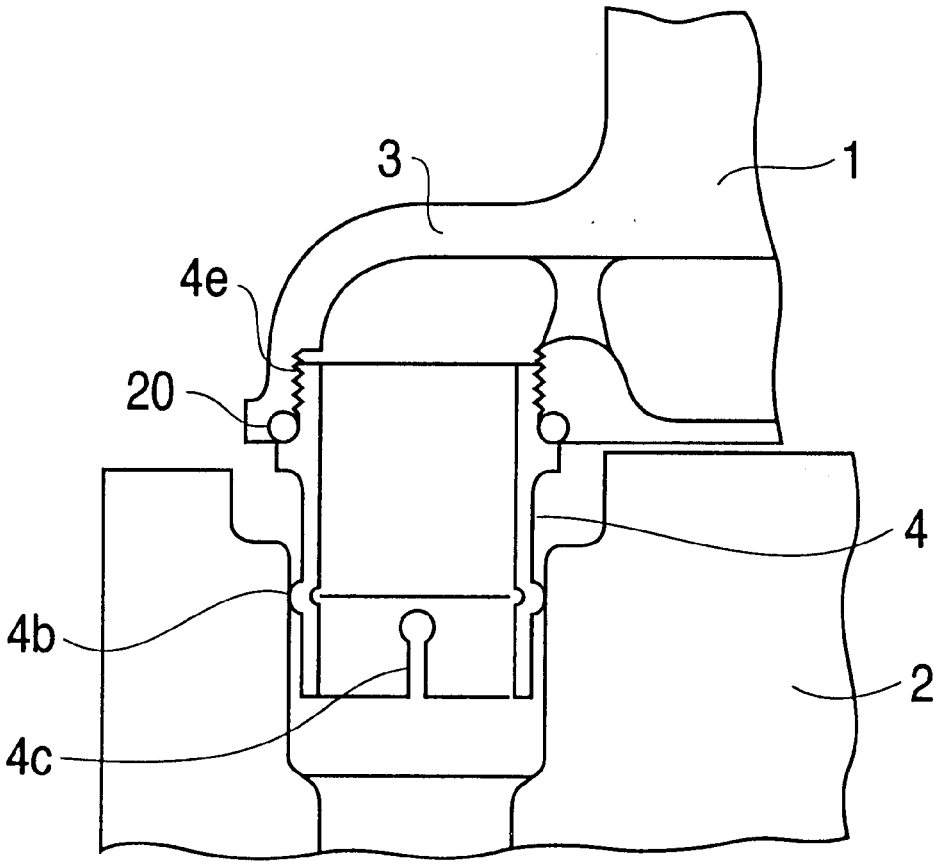
FIG. 9 is a schematic view showing another partial modification of the delivery block shown in FIG. 7.

FIGS. 8 and 9 show partial modifications of the third embodiment of the present invention of which the structure shown in FIG. 8 is such that the upper end of the delivery block 4 is expanded and the inner peripheral surface of the expanded portion is screw-threaded to provide a female-screw to thereby form an engagement section 4*d* which is clamped with a male-screw formed on the terminal end of the elbow-shaped projection 3 with a circular ring 20 interposed therebetween.

Further, the structure shown in FIG. 9 is such that instead of expanding the upper end of the delivery block 4, the outer peripheral surface of the upper end of the delivery block 4 is screw-threaded to provide a male-screwed engagement section 4*e* which is clamped with the female-screwed terminal end of the elbow-shaped projection 3 with the circular ring 20 interposed therebetween.

That is, according to the structures shown in FIGS. 8 and 9, the delivery block 4 and the blade-side cooling medium path 5 are brought into engagement with each other by the screwed engagement sections 4d and 4*e* through the circular ring 20 to provide an improved sealing property while the delivery block 4 and the disk-side cooling medium path 10 are connected to each other through the ring-shaped projection 4*b* formed on the outer peripheral surface of the delivery block 4 thereby maintaining a sufficient degree of sealing property and flexibility.

Figure 10:
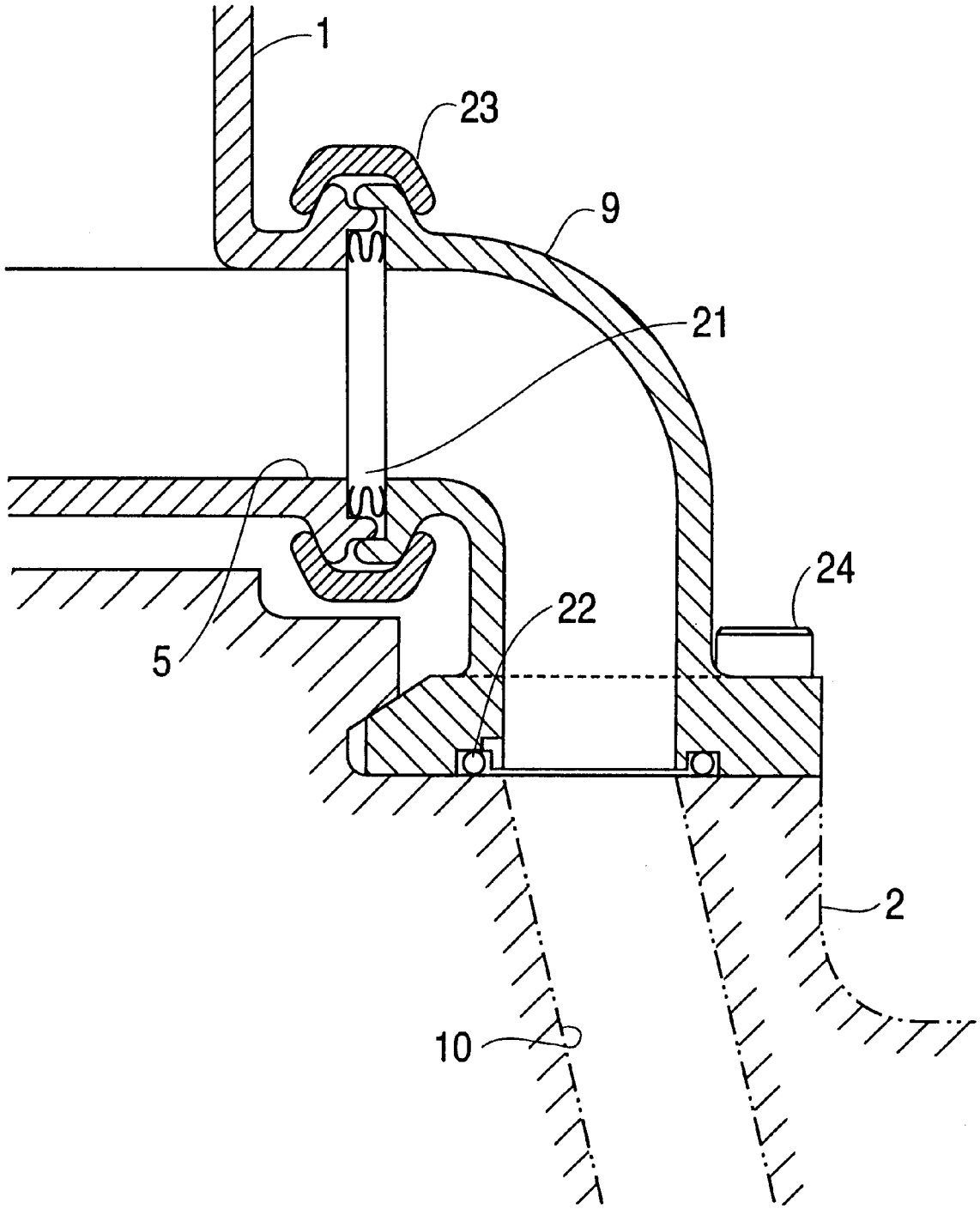
FIG. 10 is a schematic view showing a structural relationship between a blade and a disk of a gas turbine according to a fourth embodiment of the present invention.

Lastly, a fourth embodiment of the present invention will be described with reference to FIG. 10 wherein like parts are designated by like reference numerals used with respect to the above-described conventional structure and the structures according to the first through third embodiment of the present invention without making any redundant description of these like parts.

The structure according to this embodiment is such that the blade-side cooling medium path 5 and the disk-side cooling medium path 10 are arranged so as to communicate with an elbow-shaped delivery block 9.

That is, the elbow-shaped delivery block 9 is connected to the disk-side cooling medium path 10 by a bolt 24. In that case, a C-type seal 22 is interposed between block A and disc Z to thereby improve the sealing property of the flange surface.

At the same time, the elbow-shaped delivery block 9 has an E-type of type seal 21 interposed between the upper end the block 9 is connected to the root portion of the mating blade by means of bolts and the like (not shown) to thereby establish its communication with the blade-side cooling medium path 5.

Further, at the connection portion in which the E-type seal 21 is interposed, there is arranged a cover plate 23 for covering the connection portion.

In the case of this fourth embodiment, the blade-side cooling medium path 5 and the disk-side cooling medium path 10 are arranged made to communicate with each other by the elbow-shaped delivery block 9 in the above-described manner and in that case, since the C-type seal 22 and the E-type seal 21 are interposed therein, the sealing property of one of the connection portions is secured by the C-type seal 22 while the sealing property of the other connection portion is secured by the E-type seal 21.

Furthermore, since the E-type seal 21 is arranged with its inner side directed inward as shown, a spring force generated in the E-type seal 21 due to the difference between the pressure of the cooling medium flowing inside and the pressure outside the E-type seal-21 so that the sealing property of the E-type seal 21 is further secured and at the same time, since the E-type seal 21 is brought into line-contacts with the blade root portion and the elbow-shaped delivery block 9, the flexibility of these contact portions can be secured, It should be noted that although the present invention has been described with reference to several embodiments shown in the drawings, the invention is not limited thereto and it goes without saying that various kinds of modifications and changes may be made, without departing from the scope of the present invention.

As described above, the present invention provides a cooling medium path structure for the blades of a gas turbine. The structure comprises a disk-side cooling medium path, a blade-side cooling medium path, an elbow-shaped projection forming an entrance and an exit at both ends of the blade-side cooling medium path and a delivery block provided with an elastic engaging section and disposed between the disk-side cooling medium path and the elbow-shaped projection so as to establish communication between them with the elastic engaging section of the delivery block coming into elastic engagement with at least one of the elbow-shaped projection and the disk-side cooling medium path whereby the delivery of the cooling medium between the disk-side and the blade-side cooling medium paths is performed securely and accurately with a sufficient degree of flexibility against vibrations etc. while keeping the sealing property of the structure because of the elastic engagement structure of the delivery block.

Accordingly, it has become possible with the present invention to recover the cooling medium after being heated to a high temperature as a result of cooling the high-temperature portion of the gas turbine and to make the best use of such high-temperature cooling medium for other purposes.

Further, according to the present invention, since the elastic engaging section of the delivery block is formed in an extremely simple structure of the ring-shaped projections and a plurality of slits extending axially to both open ends of the delivery block, the sealing function and flexibility of the structure against leakage of the cooling medium and vibrations etc. are reliably provided and it is possible to further improve the effect of collecting the heat of the gas turbine by the provision of such a cooling medium path structure that is excellent from economical and functional points of view.

Further, according to the present invention, the elastic engaging section of the delivery block is formed by laying one above another a plurality of ring-shaped members circumscribing the inner surface of the elbow-shaped projection or the disk-side cooling medium path and a plurality of ring-shaped members inscribing the outer surface of the delivery block so that by making use of the phenomenon of thermal expansion of the ring-shaped members contacting the inner surface of the cooling medium paths and those contacting the outer surface of the delivery block and the centrifugal force acting on the overlapped ring-shaped members, it is possible to improve the sealing effect and the flexibility of the structure thereby enabling the effective delivery of the cooling medium and to make effective use of the heat of the high temperature of the gas turbine.

Still further, since the intermediate portion of the delivery block lying between the elbow-shaped projection and the turbine disk is covered with the spacer band, it is possible to accurately maintain the positional arrangement of the blade-side cooling medium path, the disk-side cooling medium path and the delivery block relative to one another and to surely perform the delivery of the cooling medium securely, thereby increasing the availability and reliability of the structure.

According to the present invention, the delivery block is brought into screw-engagement with at least one of the elbow-shaped projection and the disk-side cooling medium path so that the surface pressure of the contact surface is increased by such a screw-engagement so as to enable the construction of a cooling medium delivery system having a sharply improved sealing property and it is possible to sharply enhance the possibility of realization of heat collection of the turbine through the cooling medium and the effective use of the collected heat.

Moreover, the cooling medium path structure according to the present invention comprises the disk-side cooling medium path, the blade-side cooling medium path and the elbow-shaped delivery block disposed between the entrance and exit at both ends of the blade-side cooling medium path and the disk-side cooling medium path so as to establish communication between them and wherein the delivery block is brought into elastic engagement with the blade-side cooling medium path and the disk-side cooling medium path through the E-type seals or C-type seals thereby forming a cooling medium path structure for the blades of a gas turbine so that it is possible to improve and secure the sealing property and the flexibility of the structure by making use of the characteristics of the C-type or E-type seals arranged at the connection portions of the delivery block with the respective cooling medium paths and to make the structure safe, accurate and suitable for practical use.

What is claimed is:

1. A cooling structure for a gas turbine blade, said cooling structure comprising:

a turbine disk having a disk-side cooling medium flow path;

a blade root portion having a blade-side cooling medium flow path, and an elbow-shaped projection provided at a first side of said blade root portion, wherein an entrance of said blade-side cooling medium flow path is formed in said elbow-shaped projection; and a delivery block disposed between said turbine disk and said elbow-shaped projection in order to establish flow communication between said disk-side cooling medium flow path and said blade-side cooling medium flow path, said delivery block having an elastic engaging section for elastically engaging with at least one of said elbow-shaped projection and said disk-side cooling medium flow path, wherein said elastic engaging section comprises a ring-shaped projection and a plurality of slits extending axially from an open end of said delivery block.

2. The cooling structure as claimed in claim 1, wherein said delivery block is covered with a spacer band between said elbow-shaped projection and said turbine disk.

3. The cooling structure as claimed in claim 1, further comprising a second elbow-shaped projection formed at a second side of said blade root portion, wherein an exit end of said blade-cooling medium flow path is formed in said second elbow-shaped projection.

4. A cooling structure for a gas turbine blade, said cooling structure comprising:

a turbine disk having a disk-side cooling medium flow path;

a blade root portion having a blade-side cooling medium flow path, and an elbow-shaped projection provided at a first side of said blade root portion, wherein an entrance of said blade-side cooling medium flow path is formed in said elbow-shaped projection; and a delivery block disposed between said turbine disk and said elbow-shaped projection in order to establish flow communication between said disk-side cooling medium flow path and said blade-side cooling medium flow path, said delivery block having an elastic engaging section for elastically engaging with at least one of said elbow-shaped projection and said disk-side cooling medium flow path, said elastic engaging section of said delivery block comprising a plurality of ring-shaped members inscribing an inner peripheral surface of said elbow-shaped projection or said disk-side cooling medium flow path, and a plurality of ring-shaped members circumscribing an outer peripheral surface of said delivery block, wherein said ring-shaped members are laid one on another alternately in a vertical direction.

5. The cooling structure as claimed in claim 4, wherein said delivery block is covered with a spacer band between said elbow-shaped projection and said turbine disk.

6. The cooling structure as claimed in claim 4, further comprising a second elbow-shaped projection formed at a second side of said blade root portion, wherein an exit end of said blade-cooling medium flow path is formed in said second elbow-shaped projection.

7. A cooling structure for a gas turbine blade, said cooling structure comprising:

a turbine disk having a disk-side cooling medium flow path;

a blade root portion having a blade-side cooling medium flow path, and an elbow-shaped projection provided at a first side of said blade root portion, wherein an entrance of said blade-side cooling medium flow path is formed in said elbow-shaped projection; and a delivery block disposed between said turbine disk and said elbow-shaped projection in order to establish flow communication between said disk-side cooling medium flow path and said blade-side cooling medium flow path, said delivery block having an elastic engaging section for elastically engaging with at least one of said elbow-shaped projection and said disk-side cooling medium flow path, said delivery block being in screw-engagement with at least one of said elbow-shaped projection and said disk-side cooling medium flow path.

8. The cooling structure as claimed in claim 7, wherein said elastic engaging section comprises a ring-shaped projection and a plurality of slits extending axially from an open end of said delivery block.

9. The cooling structure as claimed in claim 7, further comprising a second elbow-shaped projection formed at a second side of said blade root portion, wherein an exit end of said blade-cooling medium flow path is formed in said second elbow-shaped projection.

10. A cooling structure for a gas turbine blade, said cooling structure comprising:

a turbine disk having a disk-side cooling medium flow path;

a blade root portion having a blade-side cooling medium flow path, and an elbow-shaped projection provided at a first side of said blade root portion, wherein an entrance of said blade-side cooling medium flow path is formed in said elbow-shaped projection; and a delivery block disposed between said turbine disk and said elbow-shaped projection in order to establish flow communication between said disk-side cooling medium flow path and said blade-side cooling medium flow path, said delivery block having a first connection portion connected to said blade-side cooling medium flow path, and a second connection portion connected to said disk-side cooling medium flow path, wherein at least one said first and second connection portions is elastically coupled to said blade-side cooling medium flow path and said disk-side cooling medium flow path, respectfully, with an E-type seal or a C-type seal interposed therebetween.

11. The cooling structure as claimed in claim 10, wherein said E-type seal is interposed between said first connection portion of said delivery block and a surface of said blade-side cooling medium flow path, and said C-type seal is interposed between said second connection portion of said delivery block and a surface of said disk-side cooling medium flow path.

12. The cooling structure as claimed in claim 10, further comprising a second elbow-shaped projection formed at a second side of said blade root portion, wherein an exit end of said blade-cooling medium flow path is formed in said second elbow-shaped projection.

* * * * *